US010495260B2

(12) United States Patent
Ishida

(10) Patent No.: US 10,495,260 B2
(45) Date of Patent: Dec. 3, 2019

(54) SAFETY VALVE SYSTEM, TANK, SHIP, AND OPERATION METHOD FOR SAFETY VALVE SYSTEM ON SHIPS

(71) Applicant: MITSUBISHI SHIPBUILDING CO., LTD., Yokohama-Shi, Kanagawa (JP)

(72) Inventor: Toshinori Ishida, Tokyo (JP)

(73) Assignee: MITSUBISHI SHIPBUILDING CO., LTD., Yokohama-Shi, Kanagawa (JP)

( * ) Notice: Subject to any disclaimer, the term of this patent is extended or adjusted under 35 U.S.C. 154(b) by 101 days.

(21) Appl. No.: 15/579,049

(22) PCT Filed: May 30, 2016

(86) PCT No.: PCT/JP2016/065886
§ 371 (c)(1),
(2) Date: Dec. 1, 2017

(87) PCT Pub. No.: WO2017/098742
PCT Pub. Date: Jun. 15, 2017

(65) Prior Publication Data

US 2018/0172213 A1 Jun. 21, 2018

(30) Foreign Application Priority Data

Dec. 10, 2015 (JP) ..... 2015-241120

(51) Int. Cl.
*F17C 13/04* (2006.01)
*F17C 13/12* (2006.01)
*F17C 13/00* (2006.01)

(52) U.S. Cl.
CPC ..... *F17C 13/04* (2013.01); *F17C 13/00* (2013.01); *F17C 13/126* (2013.01)

(58) Field of Classification Search
CPC ..... F17C 13/00; F17C 13/04; F17C 13/126; F17C 2270/0105; F17C 2265/031;
(Continued)

(56) References Cited

U.S. PATENT DOCUMENTS 3,583,432 A 6/1971 Powell et al.
4,669,493 A 6/1987 Kober et al.
(Continued)

FOREIGN PATENT DOCUMENTS

DE 2731804 A1 1/1979
GB 1466935 A 3/1977
(Continued)

OTHER PUBLICATIONS

PCT/ISA/210, "International Search Report for International Application No. PCT/JP2016/065886," dated Aug. 30, 2016.
(Continued)

*Primary Examiner* — Eric Keasel
(74) *Attorney, Agent, or Firm* — Manabu Kanesaka; Benjamin Hauptman; Kenneth Berner

(57) ABSTRACT

A safety valve system includes a main valve that includes an introduction port into which pressure from a tank is introduced, and a release port to release the pressure; a high-pressure side pilot valve and a low-pressure side pilot valve that are set to mutually different operating pressure values and that release pressure by making the introduction port and the release port communicate with each other when the pressure exceeds the operating pressure value; and a switching unit that switches so that only the low-pressure side pilot valve, which excludes the high-pressure side pilot valve with the highest operating pressure value, do not operate.

12 Claims, 6 Drawing Sheets

(58) Field of Classification Search
CPC ..... F17C 2260/021; F17C 2250/0636; F17C 2250/043; F17C 2223/043; F17C 2223/033; F17C 2223/0161; F17C 2221/035; F17C 2221/033; F17C 2205/0332; F17C 2205/0323; F17C 2201/052
See application file for complete search history.

(56) References Cited

U.S. PATENT DOCUMENTS

| | | | | |
|---|---|---|---|---|
| 4,911,192 | A * | 3/1990 | Hartfiel | F15B 19/002 137/14 |
| 5,699,839 | A | 12/1997 | Dehne | |
| 6,568,416 | B2 * | 5/2003 | Tucker | G05D 16/2053 137/14 |
| 2001/0010239 | A1 | 8/2001 | Mutter | |
| 2008/0190117 | A1 | 8/2008 | Lee et al. | |

FOREIGN PATENT DOCUMENTS

| | | | |
|---|---|---|---|
| JP | S60-164098 | A | 8/1985 |
| JP | S61-244998 | A | 10/1986 |
| JP | 2001-254867 | A | 9/2001 |
| JP | 2010-144878 | A | 7/2010 |
| JP | 4750097 | B2 | 8/2011 |

OTHER PUBLICATIONS

PCT/ISA/237 "Written Opinion of the International Searching Authority for International Application No. PCT/JP2016/065886," dated Aug. 30, 2016.

* cited by examiner

SAFETY VALVE SYSTEM, TANK, SHIP, AND OPERATION METHOD FOR SAFETY VALVE SYSTEM ON SHIPS

TECHNICAL FIELD

The present invention relates to a safety valve system, tank, a ship, and an operation method for a safety valve system on ships.

Priority is claimed on Japanese Patent Application No. 2015-241120, filed Dec. 10, 2015, the content of which is incorporated herein by reference.

BACKGROUND ART

Carriers that carry liquefied gas, such as liquefied natural gas (LNG) or liquefied petroleum gas (LPG), include a tank that accommodates the liquefied gas. If the liquefied gas within the tank is not in a supercooled state, the liquefied gas within the tank evaporates due to the heat that enters the inside of the tank from the outside of the tank. If the amount of evaporation of the liquefied gas exceeds the amount of the gas to be discharged from the tank, the pressure within the tank increases.

The tank includes a safety valve such that the pressure within the tank does not increase excessively. A pressure value at which the safety valve operates is set on the basis of the allowable pressure or the like of the tank. The safety valve opens a main valve inside the safety valve and releases the gas within the tank to the outside when the pressure within the tank reaches a predetermined operating pressure value.

During the navigation of the carriers, the amount of evaporation of the liquefied gas may increase due to the fluctuation of the liquefied gas within the tank in addition to the heat that enters the inside of the tank from the outside of the tank. Thus, a configuration in which the set pressure value of a safety valve is changed during navigation is disclosed in Patent Document 1.

Here, as the safety valve, there is a direct acting type or a pilot type. In the direct acting type safety valve, a valve body of a main valve is directly pressed against a valve seat from one side by a spring, and when the pressure acting on the other side of the valve body exceeds a pressing force generated by the spring, the main valve is opened. Meanwhile, the pilot type safety valve has a structure in which areas that receive pressures are made different while making a pressure acting on one side of the valve body and a pressure acting on the other side equal to each other, and a load that presses the valve body against the valve seat is exerted. In this pilot type safety valve, as a pilot valve reduces the pressure that presses the valve body against the valve seat, the valve body is separated from the valve seat and the main valve is opened. The structure of the pilot valve resembles the structure of the above-described direct acting type safety valve, the valve body of the pilot valve is directly pressed from one side by the spring, and when the pressure acting on the other side of the valve body exceeds the pressing force generated by the spring, the valve body is separated from the valve seat and the pilot valve is operated. Such a pilot type safety valve is opened and releases pressure when the pressure on the other side of the main valve acts on the pilot valve and exceeds the pressing force generated by the spring of the pilot valve. The pressure that presses the valve body of the pilot valve against the spring is equal to the pressure acting on the valve body of the main valve, and if the pilot valve operates, the pressure that presses the valve body of the main valve against the valve seat decreases, and the main valve is opened. Generally, the pilot type safety valve is used for tanks of large-sized liquefied gas carriers.

In order to switch the operating pressure value of such a pilot type safety valve, it is necessary to replace the spring itself of the pilot valve with one having a different spring constant or change the number of springs to be mounted on the pilot valve.

CITATION LIST

Patent Literature

Patent Document 1 Japanese Patent No. 4750097

SUMMARY OF INVENTION

Technical Problem

However, in the safety valve described in Patent Document 1, an operator switches the operating pressure value by adding the in of the pilot valve through a manual operation. Therefore, there is a problem in that it is difficult to perform discrimination as to whether or not switching is appropriately performed (whether or not an additional spring is appropriately attached).

An object of this invention is to provide a safety valve system, a tank, a ship, and an operation method for a safety valve system on ships that can easily switch the operating pressure value of a safety valve.

Solution to Problem

According to a first aspect of the invention, a safety valve system has an introduction port into which pressure from a pressure source is introduced, and a release port which releases the pressure. The safety valve system further includes a main valve that partitions the introduction port and the release port. The safety valve system further includes a plurality of pilot valves that are set to mutually different operating pressure values and that release the pressure by allowing the introduction port and the release port to communicate with each other by opening the main valve when the pressure exceeds the operating pressure values. The safety valve system further includes a switching unit that performs switching such that all the other pilot valves excluding the pilot valve with the highest operating pressure value among the plurality of pilot valves do not operate.

By adopting such a configuration, if all the other pilot valves excluding the pilot valve with the highest operating pressure value among the plurality of pilot valves are switched to an inoperable state, that is, is switched not to operate in the switching unit, only the pilot valve with the highest operating pressure value is brought into an operable state. If all the other pilot valves excluding the pilot valve with the highest operating pressure value among the plurality of pilot valves are switched to the operable state in the switching unit, only the pilot valve with the highest operating pressure value is brought into an operable state, other pilot valves with operating pressure values that are lower than the operating pressure value of the pilot valve with the highest operating pressure value can be brought into the operable state. Accordingly, simply by performing a switching operation with the switching unit without performing attachment and detachment of a spring, or the like, it is possible to easily switch the operating pressure values in the safety valve.

The pilot valve with the highest operating pressure value is brought into an always operable state irrespective of the states of the other pilot valves. In this way, since there is no need for an operator to perform any switching operation at least in the pilot valve with the highest operating pressure value, an operation error does not happen. Since a movable part accompanying the switching is not present, either, trouble, such as a failure, hardly occurs. As a result, the reliability of the safety valve system with respect to a maximum operating pressure can be enhanced.

In the safety valve system according a second aspect of the invention based on the first aspect, the switching unit may include an opening-closing valve in a pressure introduction line that introduces pressure into the other pilot valves.

By adopting such a configuration, if the opening-closing valve is closed, a state where the pressure is not introduced into the other pilot valves is brought about. In this way, simply by opening and closing the opening-closing valve, it is possible to easily switch the operation states of the pilot valves in the switching unit.

In the safety valve system according to a third aspect of the invention based on the second aspect, the opening-closing valves may be respectively provided on both sides of the other pilot valves.

By adopting such a configuration, if the opening-closing valves on both sides of the pilot valves are closed, a state where the pressure is not reliably introduced into the other pilot valves can be brought about. As a result, the reliability of the system is enhanced.

The safety valve system according to a fourth aspect of the invention based on the third aspect may further include a pressure detecting unit that detects a pressure between the opening-closing valves on both sides of the other pilot valves.

By adopting such a configuration, whether or not the opening-closing valves on both sides of the pilot valves are closed, that is, whether or not switching operations of the plurality of pilot valves are correctly performed can be confirmed. If the pressure detected by the pressure detecting unit increases in a state where the opening-closing valves on both sides of the pilot valves are closed, occurrence of a leak in one or both of the opening-closing valves on both sides of any one of the pilot valves can be detected.

In the safety valve system according to a fifth aspect of the invention based on any one aspect of the second to fourth aspects, the opening-closing valve may be an electromagnetic valve or a manual valve with an opening/closing detector. The safety valve system may further include control unit that controls an opening/closing operation of the electromagnetic valve, or a detecting unit that detects opening and closing of the manual valve with the opening/closing detector.

By adopting such a configuration, the opening-closing valve can be opened and closed by a remote operation, and the open/closed state of the opening-closing valve can be monitored at a position apart from the opening-closing valve.

The safety valve system according to a sixth aspect of the invention based on any one aspect of the second to fourth aspects may further include cutoff valves that are provided in front of and behind the opening-closing valve and are capable of cutting off flow to the opening-closing valve.

By adopting such a configuration, when the opening the closing valve is maintained or replaced, flow to the opening-closing valve can be cut off by closing the cutoff valves in front of and behind the opening-closing valve. Accordingly, the workability when maintenance or the like of the opening-closing valve is performed can be improved.

The safety valve system according to a seventh aspect of the invention based on the sixth aspect may further include a bypass flow passage that is parallel with the opening-closing valve; and a bypass valve that opens and closes the bypass flow passage.

By adopting such a configuration, when the opening the closing valve is maintained or the opening the closing valve is replaced, a fluid flowing into the opening-closing valve can be detoured by the bypass flow passage by opening the bypass valve while closing the cutoff valves in front of and behind the opening-closing valve.

The safety valve system according to an eighth aspect of the invention based on any one aspect of the first to seventh aspects may further include a pressure-reducing unit that reduces the pressure to be introduced into the plurality of pilot valves.

If the pressure in the system exceeds the operating pressure value of the pilot valve at a switching destination when transition is made from a state where only the pilot valve with the highest operating pressure value is operated to a state where only the pilot valve with the lower operating pressure value operated, there is a possibility that the pilot valve at the switching destination may operate and the pressure may be released simultaneously with the switching of the switching unit. In such a case, prior to performing switching in the switching unit, pressure can be reduced by the pressure-reducing unit. For that reason, a state where the pressure introduced into the pilot valve at the switching destination is lower than the operating pressure value can be brought about.

The safety valve system according to a ninth aspect of the invention based on any one aspect of the first to eighth aspects may further include a system internal pressure detecting unit that detects the pressure to be introduced from the pressure source.

By adopting such a configuration, for example, when the pressure-reducing unit performs the pressure-reducing processing, it can be reliably confirmed whether or not the pressure after the pressure reduction falls below the operating pressure values of the other pilot valves.

In the safety valve system according to a tenth aspect of the invention based on any one aspect of the first to ninth aspects, the pilot valve with the highest operating value may be set to the highest operating pressure value by including a plurality of springs in series, and the plurality of springs may be attachable and detachable.

By adopting such a configuration, if at least one of the plurality of springs is detached, the pilot valve can be switched to the lower operating pressure value. For that reason, in case where trouble or the like has occurred in the other pilot valves with the low operating pressure values, the pilot valve with the highest operating pressure value can be used instead.

According to an eleventh aspect of the invention, a tank includes a tank body that accommodates fluid as the pressure source; and the safety valve system according to any one of the first to tenth aspects.

By adopting such a configuration, maintenance can be reliably performed such that the pressure within the tank does not become excessively high by the safety valve system.

According to a twelfth aspect of the invention, a ship includes a hull; and the tank according to the eleventh aspect mounted on the hull.

By adopting such a configuration, the ship can be reliably maintained such that the pressure within the tank mounted on the hull does not become excessively high by the safety valve system.

According to a thirteenth aspect of the invention, an operation method for a safety valve system on ships is an operation method for a safety valve system in the ship according to twelfth aspect. In the operation method for a safety valve system, only the other pilot valves excluding a pilot valve with the highest operating pressure value among a plurality of pilot valves are made not to operate in a state where the hull is anchoring. In the operation method for a safety valve system, the other pilot valves excluding the pilot valve with the highest operating pressure value among the plurality of pilot valves are allowed to operate in a state where the hull is navigating.

By adopting such a configuration, the operating pressure value at which the pressure within the tank is released can be set to a higher state as compared to the states during navigation and anchorage. As a result, more fluid can be delivered when the fluid within the tank is delivered to a ground facility or the like.

Advantageous Effects of Invention

According to the above-described safety valve system, tank, ship, and operation method for a safety valve system in the ship, it is possible to easily switch the operating pressure value of the safety valve.

DESCRIPTION OF EMBODIMENTS

Next, a safety valve system, a tank, ship, a ship, and an operation method for a safety valve system related to embodiments of this invention will be described with reference to the drawings.

First Embodiment

Figure 1:
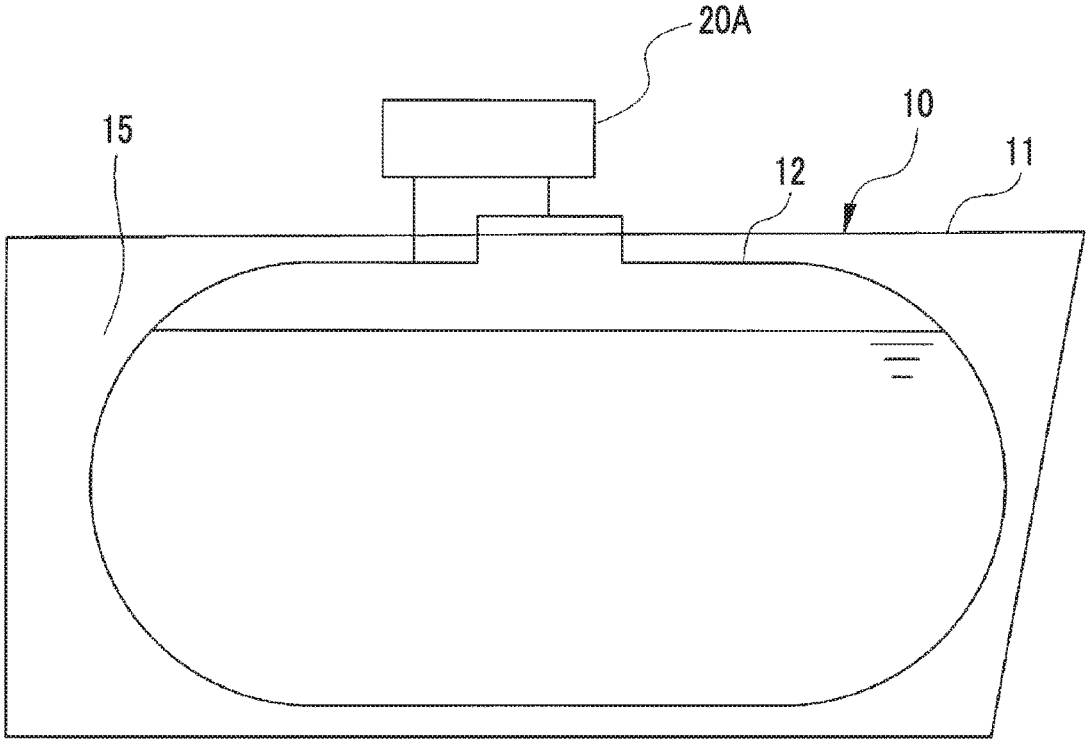
FIG. 1 is a view illustrating a schematic configuration of a ship including a tank related to a first embodiment of this invention.

FIG. 1 is a view illustrating a schematic configuration of a ship including a tank in a first embodiment.

Figure 2:
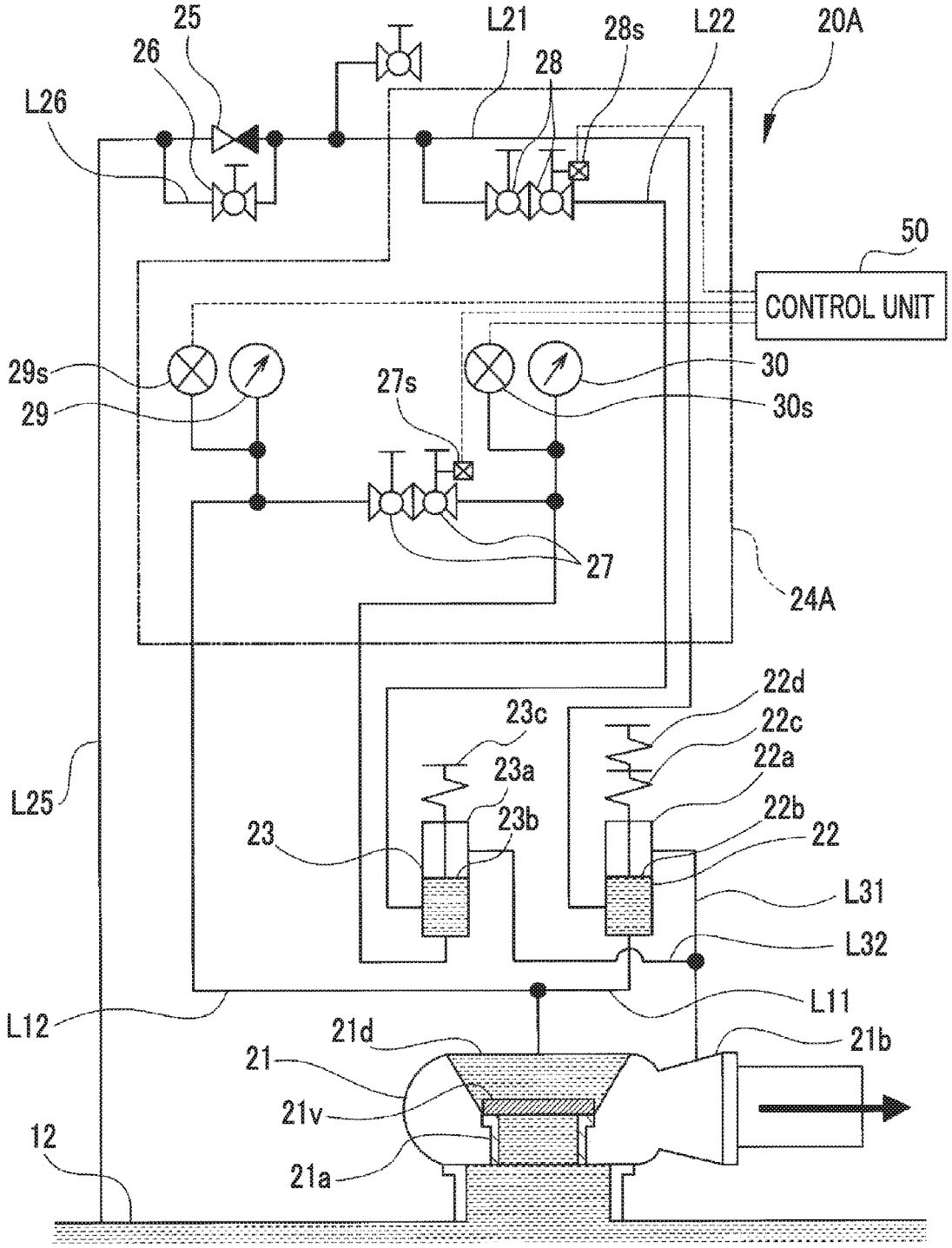
FIG. 2 is a view illustrating the configuration of a safety valve system provided in the above tank.

FIG. 2 is a view illustrating the configuration of a safety valve system provided in the tank.

As illustrated in FIG. 1, a carrier (ship) 10 of this embodiment carries liquefied gas, such as liquefied natural gas (LNG) or liquefied propane gas (LPG). The carrier 10 includes at least a hull 11, a tank (a pressure source, a tank body) 12, and a safety valve system 20A.

The hull 11 includes a tank accommodating part 15 that opens upward.

The tank 12 is made of an aluminum alloy, for example, and is provided within the tank accommodating part 15.

The tank 12 accommodates liquefied gas serving as an object to be carried therein.

Here, the shape and structure of the tank 12, the number of installed tanks, and the like are not limited at all.

As illustrated in FIG. 2, the safety valve system. 20A includes a main valve 21, a high-pressure side pilot valve 22, a low-pressure side pilot valve 23, a switching unit 24A, a check valve 25, and a pressure-reducing valve (pressure-reducing unit) 26.

The main valve 21 has an introduction port 21*a*, a release port 21*b*, a dome chamber 21*d*, and a valve body 21*v*. The introduction port 21*a* is coupled to an upper part of the tank 12 (refer to FIG. 1), and gas, such as evaporative gas within the tank 12, is introduced into the introduction port 21*a*. Accordingly, the pressure P within the tank 12 acts on the valve body of the main valve 21 through the introduction port 21*a*. The release port 21*b* opens toward a riser (not illustrated) or the like. The valve body 21*v* is opened and closed in accordance with a pressure difference between the introduction port 21*a* and the dome chamber 21*d*. In a case where the pressure of the introduction port 21*a* and the pressure of the dome chamber 21*d* are equal to each other, the valve body 21*v* is wrought into a closed state. The introduction port 21*a* and the release port 21*b* are cut off in the closed state of the valve body 21*v*, and the introduction port 21*a* and the release port 21*b* are allowed to communicate with each other in an open state of the valve body 21*v*.

The high-pressure side pilot valve 22 includes a valve body 22*b* within a housing 22*a*. The valve body 22*b* is biased in a direction in which the valve body 22*b* is closed by springs 22*c* and 22*d* connected in series to the valve body 22*b*. One spring 22*d* out of the springs 22*c* and 22*d* is attachable to and detachable. In this embodiment, the same springs 22*c* and 22*d* are provided in series at the valve body 22*b*.

A first pressure introduction line L11 and a first return line L21 are connected to a first side of the housing 22*a*.

The first pressure introduction line L11 is further connected to the dome chamber 21*d* of the main valve 21.

The first return line L21 is connected to the tank 12 via a return line L25. The first return line L21 introduces gas, such as evaporative gas within the tank 12, into the housing 22*a* from the first side of the housing 22*a*.

A first pressure release line L31 is connected to a second side of the housing 22*a*. The first pressure release line L31 is further connected to the release port 21*b* of the main valve 21.

The gas within the tank 12 flows into the high-pressure side pilot valve 22 within the housing 22*a* via the first return line L21. Accordingly, the pressure P of the gas acts on a first side of the valve body 22*b*. A biasing force caused by the springs 22*c* and 22*d* acts on a second side of the valve body 22*b*. For that reason, unless the pressure P exceeds the biasing force, the valve body 22*b* maintains a closed state.

If the pressure P exceeds the biasing force of the springs 22*c* and 22*d*, the valve body 22*b* is opened and the first return line L21 and the first pressure release line L31 communicate with each other via the housing 22*a*. Accordingly, the gas introduced into the housing 22*a* from the first return line L21 flows into the release port 21*b* of the main valve 21 via the first pressure release line L31. Then, the pressure of the first pressure introduction line L11 connected to the housing 22*a* decreases, and the pressure of the dome chamber 21*d* of the main valve 21 decreases. As a result, a pressure difference occurs between the introduction port 21*a* of the main valve 21 and the dome chamber 21*d*, and the valve body 21*v* is opened to allow the introduction port 21*a* and the release port 21*b* to communicate with each other. Accordingly, the pressure P within the tank 12 is released through the main valve 21.

Here, the high-pressure side pilot valve 22 has a greater number of springs 22*c* and 22*d* than that of the low-pressure side pilot valve 23, and a pressure value when releasing the pressure P, that is, an operating pressure value X1 of the high-pressure side pilot valve 22, is set to be higher than an operating pressure value X2 of the low-pressure side pilot valve 23.

The low-pressure side pilot valve 23 includes a valve body 23*b* within a housing 23*a*. The valve body 23*b* is biased in a direction in which the valve body 23*b* is closed by a spring 23*c*. The spring 23*c* is equivalent to the springs 22*c* and 22*d* of the high-pressure side pilot valve 22. Since the low-pressure side pilot valve 23 has a smaller number of springs 23*c* than that of the high-pressure side pilot valve 22, the pressure P at which the valve body 23*b* is opened is lower than that of the high-pressure side pilot valve 22.

A second pressure introduction line (pressure introduction line) L12 and a second return line L22 are connected to a first side of the valve body 23*b* within the housing 23*a*.

The second pressure introduction line L12 is connected to the dome chamber 21*d* of the main valve 21.

The second return line L22 is connected to the tank 12 via the return line L25. The second return line L22 introduces the gas within the tank 12 into the housing 23*a* from the first side of the housing 23*a*. A second pressure release line L32 is connected to a second side of the housing 23*a*. The second pressure release line L32 is connected to the release port 21*b* of the main valve 21.

The gas within the tank 12 flows into the low-pressure side pilot valve 23 within the housing 23*a* from the second return line L22. Accordingly, the pressure P of the gas within the tank 12 acts on a first side of the valve body 23*b*. Since a biasing force caused by the spring 23*c* is acting on a second side of the valve body 23*b*, the valve body 23*b* maintains a closed state unless the pressure P exceeds the biasing force.

If the pressure P exceeds the biasing force of the spring 23*c*, the valve body 23*b* opened and the second return line L22 and the second pressure release line L32 communicate with each other via the housing 23*a*. Accordingly, the gas introduced into the housing 23*a* from the second return line L22 flows into the release port 21*b* of the main valve 21 via the second pressure release line L32. Then, the pressure of the second pressure introduction line L12 decreases, and the pressure of the dome chamber 21*d* of the main valve 21 also decreases. As a result, a pressure difference occurs between the introduction port 21*a* of the main valve 21 and the dome chamber 21*d*, and the valve body 21*v* is opened to allow the introduction port 21*a* and release port 21*b* to communicate with each other. Accordingly, the pressure P within the tank 12 is released through the main valve 21. Here, the number of springs 23*c* of the low-pressure side pilot valve 23 than the number of springs of the high-pressure side pilot valve 22, and the operating pressure value X2 of the low-pressure side pilot valve 23 is set to be lower than the operating pressure value X1 of the high-pressure side pilot valve 22.

The switching unit 24A performs switching between introduction and non-introduction of the gas within the tank 12 into the low-pressure side pilot valve 23. The switching unit 24A includes a first opening-closing valve (opening-closing valve) 27 and a second opening-closing valve (opening-closing valve) 28.

The first opening-closing valve 27 is provided at the second pressure introduction line L12 closer to the main valve 21 than the low-pressure side pilot valve 23. The same first opening-closing valves 27 are doubly provided in series. Normally, one of the first opening-closing valves 27 is opened and closed, and the other valve is always brought into an open state.

The first opening-closing valve 27 closer to the low-pressure site pilot valve 23 is provided with a limit switch 27*s* that detects an open/closed state of the first opening-closing valve 27. A detection signal of the limit switch 27*s* is output to a control unit 50 of the safety valve system 20A.

The second opening-closing valve 28 is provided at the second return line L22 opposite to the main valve 21 across the low-pressure side pilot valve 23. Similarly to the first opening-closing valves 27, the same second opening-closing valves 28 also doubly provided in series. Normally, one of the second opening-closing valves 28 is opened and closed, and the other valve is always brought into an open state. The second opening-closing valve 28 closer to the low-pressure side pilot valve 23 is provided with a limit switch 28*s* that detects an open/closed state of the second opening-closing valve 28. A detection signal of the limit switch 28*s* is output to the control unit 50 of the safety valve system 20A.

By opening and closing the first opening-closing valves 27 and the second opening-closing valves 28, the switching unit 24A capable of performing switching between introduction and non-introduction of the gas within the tank 12 into the low-pressure side pilot valve 23. More specifically, by opening the first opening-closing valves 27 and the second opening-closing valves 28, the gas within the tank 12 is introduced into the low-pressure side pilot valve 23. If both of the first opening-closing valves 27 and the second opening-closing valves 28 are closed, the introduction of the gas within the tank 12 into the low-pressure side pilot valve 23 is cut off.

The switching unit 24A further includes a pressure gauge (system internal pressure detecting unit) 29 and a pressure gauge (pressure detecting unit) 30.

The pressure gauge 29 is provided on the side of the second pressure introduction line L12 closer to the main valve 21 than the first opening-closing valves 27, and detects the pressure P of the dome chamber 21*d* of the main valve 21. The pressure gauge 29 is provided with a pressure transmitter 29*s*, and a detection signal thereof is output to the control unit 50 of the safety valve system 20A.

The pressure gauge 30 is provided between the first opening-closing valves 27 and the second opening-closing valves 28. In this embodiment, the pressure gauge 30 is disposed between the first opening-closing valves 27 and the low-pressure side pilot valve 23 in the second pressure introduction line L12. The pressure gauge 30 detects the pressure P of the gas introduced into the low-pressure side pilot valve 23. The pressure gauge 30 is provided with a pressure transmitter 30*s*, and a detection signal thereof is output to the control unit 50 of the safety valve system 20A.

The check valve 25 is provided at the return line L25, and cuts off the flow of the gas from the high-pressure side pilot valve 22 and the low-pressure side pilot valve 23 to the tank 12. On the contrary, the check valve 25 allows the inflow of the gas toward the high-pressure side pilot valve 22 and the low-pressure side pilot valve 23 from the tank 12.

The pressure-reducing valve 26 is provided at a bypass line L26 that bypasses the check valve 25. By opening the pressure-reducing valve 26, the gas in each line within the safety valve system 20A can be returned to the tank 12, and the pressure of each line can be reduced. In this embodiment, the pressure-reducing valve 26 is not limited to a manual valve, and may be substituted with, for example, manual valves including an electromagnetic valve and a position switch.

During the navigation of the above-described carrier 10, in addition to the liquefied gas being evaporated and gasified within the tank 12, the liquefied gas fluctuates or is accelerated within the tank 12 and thus, the pressure P tends to increase. In contrast, in a case where the carrier 10 is anchoring, the fluctuation of the gas within the tank 12 is small, and an unintended increase in the pressure P hardly occurs. Thus, in this embodiment, the operating pressure value of the safety valve system 20A is changed during navigation and anchorage.

Figure 3:
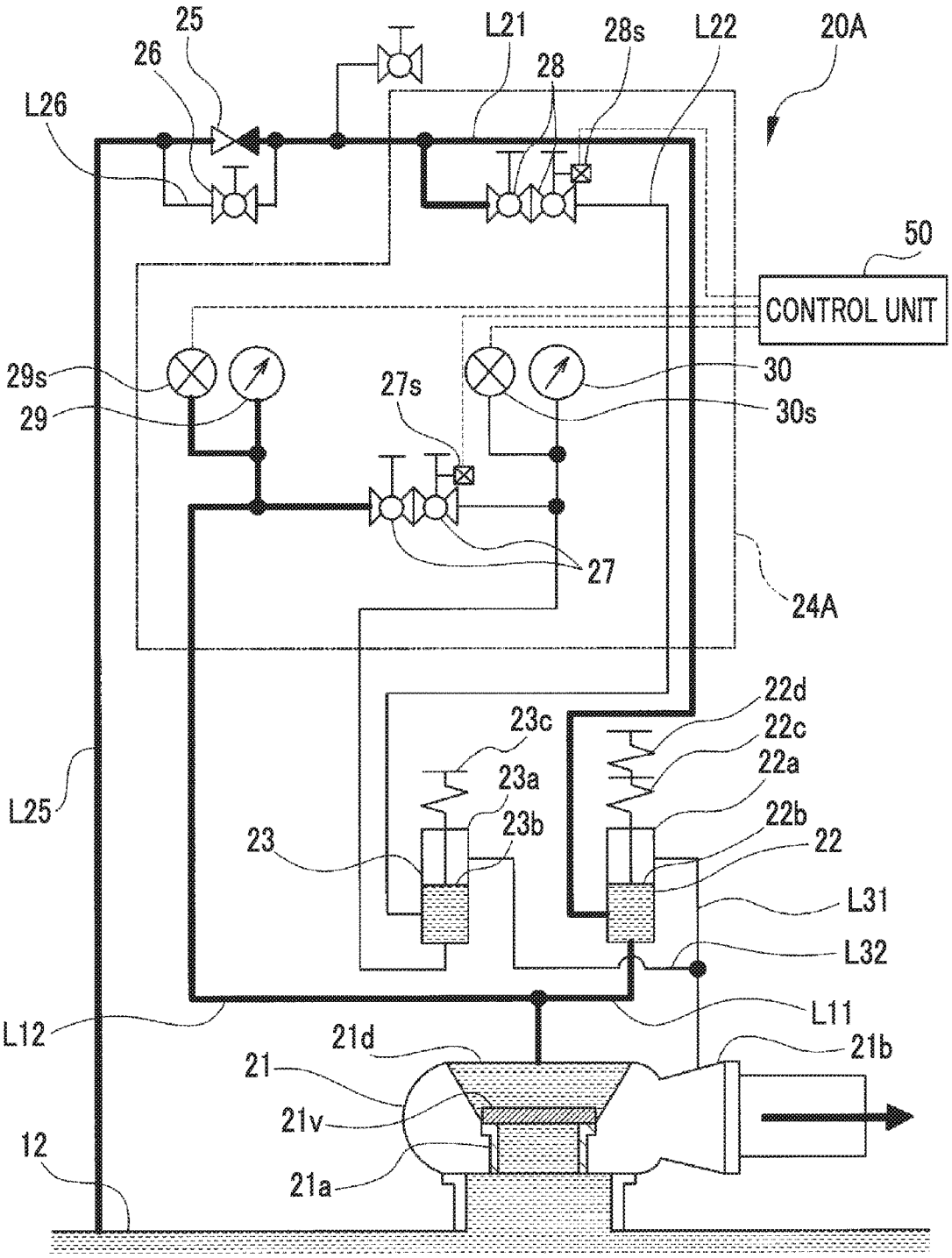
FIG. 3 is a view illustrating a high-pressure setting operation state in the safety valve system including two sets of pilot valves.

FIG. 3 is a view illustrating a high-pressure setting operation state of the safety valve system 20A in the safety valve system including the two sets of pilot valves. In FIG. 3, a portion illustrated by a thick line represents a portion through which gas passes.

As illustrated in FIG. 3, in the safety valve system including the two sets of valves, in the high-pressure setting operation state, both of the first opening-closing valves 27 and the second opening-closing valve 28 of the switching unit 24A of the low-pressure side pilot valve 23 are closed, and introduction of the gas within the tank 12 into the low-pressure side pilot valve 23 is cut off. Then, the pressure P within the tank 12 acts only on the high-pressure side pilot valve 22.

The high-pressure side pilot valve 22 maintains a closed state unless the pressure P exceeds the operating pressure value X1. If the pressure P exceeds the operating pressure value X1, the high-pressure side pilot valve 22 is opened. Then, the pressure P within the high-pressure side pilot valve 22 is released via the release port 21*b* of the main valve 21.

Accordingly, the pressure of the first pressure introduction line L11 decreases, and the pressure of the dome chamber 21*d* of the main valve 21 also decreases. As a result, a pressure difference occurs between the introduction port 21*a* of the main valve 21 and the dome chamber 21*d*, and the valve body 21*v* of the main valve 21 is opened to allow the introduction port 21*a* and the release port 21*b* to communicate with each other. Accordingly, the pressure P within the tank 12 is released through the main valve 21, and the pressure P within the tank 12 can be kept from becoming excessively high.

In the high-pressure setting operation state, the control unit 50 of the safety valve system 20A acquires a detection value of the pressure transmitter 30*s* to periodically monitor the detection value.

Since both of the first opening-closing valves 27 and the second opening-closing valves 28 are closed in the high-pressure setting operation state, a detection Value of the pressure gauge 30 maintains a relatively low state. However, in a case where it is confirmed that the detection value of the pressure gauge 30 tends to increase, a leak occurs in at least any one of the first opening-closing valves 27 and the second opening-closing valves 28. Then, there is a possibility that, while in an anchored state, the low-pressure side pilot valve 23 may operate, and the low-pressure side pilot valve 23 may be opened at the pressure P lower than the operating pressure value X1 of the high-pressure side pilot valve 22.

Thus, in a case where it is confirmed that the detection value of the pressure gauge 30 tends to increase, the same first opening-closing valves 27 and the same second opening-closing valves 28 are double provided. Thus, the first opening-closing valve 27 and the second opening-closing valve 28, which are not normally used in both of the first opening-closing valves 27 and the second opening-closing valves 28 are closed. Accordingly, the low-pressure side pilot valve 23 can be prevented from operating in the high-pressure setting state.

Figure 4:
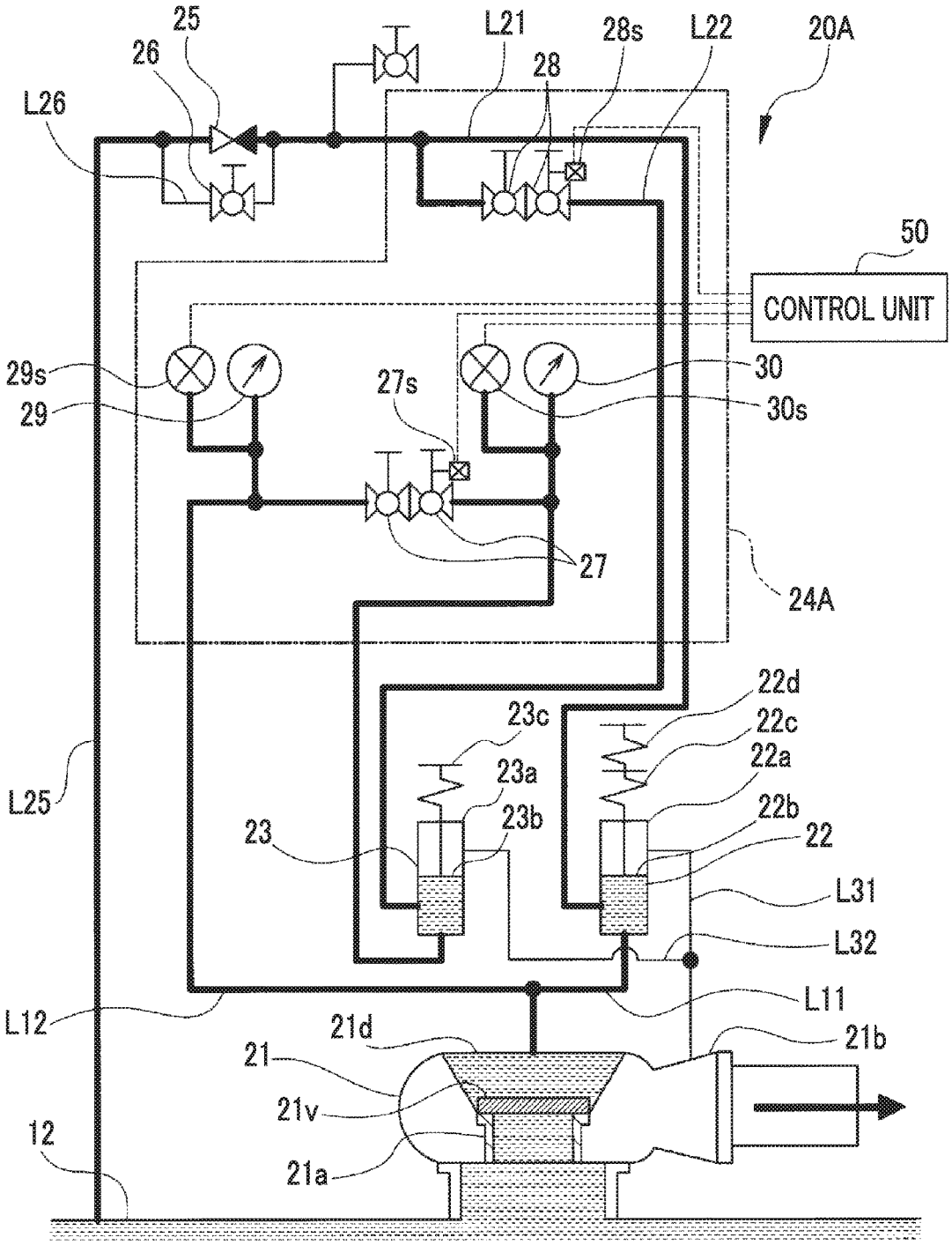
FIG. 4 is a view illustrating a low-pressure setting operation state in the safety valve system including two sets of pilot valves.

FIG. 4 is a view illustrating a low-pressure setting operation state of safety valve system 20A in the safety valve system including the two sets of pilot valves. In FIG. 4, a portion illustrated by a thick line represents a portion through which gas passes.

As illustrated in FIG. 4, in the safety valve system including the two sets of pilot valves, in the low-pressure setting operation state, both of the first opening-closing valves 27 and the second opening-closing valve 28 of the switching unit 24A of the low-pressure side pilot valve are opened. Then, the pressure P within the tank 12 acts on the high-pressure side pilot valve 22 and the low-pressure side pilot valve 23.

The low-pressure side pilot valve 23 maintains a closed state unless the pressure P exceeds the operating pressure value X2 of the low-pressure side pilot valve 23. If the pressure P exceeds the operating pressure value X2, the low-pressure side pilot valve 23 is opened, and the pressure P within the low-pressure side pilot valve 23 is released via the release port 21*b* of the main valve 21. Accordingly, the pressure of the second pressure introduction line L12 decreases, and the pressure of the dome chamber 21*d* of the main valve 21 also decreases. As a result, a pressure difference between the introduction port 21*a* of the main valve 21 and the dome chamber 21*d* occurs, and the valve body 21*v* is opened to allow the introduction port 21*a* and the release port 21*b* to communicate with each other. Accordingly, the pressure P within the tank 12 is released through the main valve 21, and the pressure P within the tank 12 can be kept from becoming excessively high.

Here, in the low-pressure setting operation state, both of the first opening-closing valves 27 and the second opening-closing valve 28 of the switching unit 24A are opened. The open/closed state of the first opening-closing valves 27 and the second opening-closing valves 28 can be confirmed by the control unit 50 of the safety valve system 20A with the detection signals from the limit switches 27*s* and 28*s* that are respectively provided in the first opening-closing valves 27 and the second opening-closing valves 28.

Moreover, in the control unit 50 of the safety valve system 20A, the detection value of the pressure gauge 30 can be acquired from the pressure transmitter 30*s*, and the open/closed state of the first opening-closing valves 27 and the second opening-closing valves 28 can be monitored. In the control unit 50, if the detection value in the pressure transmitter 30*s* is lower than a predetermined threshold value, both of the first opening-closing valves 27 and the second opening-closing valves 28 are closed, and as illustrated in FIG. 3, it can be confirmed that transition to a state where the pressure P of the tank 12 is acting only on the high-pressure side pilot valve 22 is proceeding.

When the carrier 10 transits from the high-pressure setting operation state to the low-pressure setting operation state, both of the first opening-closing valves 27 and the second opening-closing valve 28 of the switching unit 24A are opened. In this case, if the pressure P exceeds the operating pressure value X2 of the low-pressure side pilot valve 23, the first opening-closing valves 27 and the second opening-closing valve 28 of the switching unit 24A are opened, and simultaneously, the low-pressure side pilot valve 23 is opened. Thus, when the carrier 10 transits from the high-pressure setting operation state to the low-pressure setting operation state, the pressure-reducing valve 26 is first operated to perform the pressure-reducing processing of reducing the pressure within the safety valve system 20A to the operating pressure value X2 or lower. After this pressure-reducing processing, the pressure gauge 29 detects the pressure P of the dome chamber 21*d* of the main valve 21. In the control unit 50 of the safety valve system 20A, the detection value of the pressure gauge 29 is acquired from the pressure transmitter 29*s*. If the detection value in the pressure transmitter 29*s* is lower than the operating pressure value X2, it can be confirmed that the pressure-reducing processing using the pressure-reducing valve 26 is correctly performed.

Hence, according to the above-described embodiment, if switching is performed in the switching unit 24A such that only the low-pressure side pilot valve 23 is operated, only a high-pressure side pilot valve 22 of which the operating pressure value X1 is highest can be brought into an operable state. If the switching unit 24A switches the low-pressure side pilot valve 23 to an operable state, the low-pressure side pilot valve 23 can be brought into the operable state. Accordingly, simply by performing a switching operation with the switching unit 24A without performing attachment and detachment of a spring, or the like, it is possible to easily switch the operating pressure values X1 and X2 in the safety valve system 20A.

The high-pressure side pilot valve 22 of which the operating pressure value X1 is highest always operates irrespective of the operation state of the low-pressure side pilot valve 23. For that reason, at least in the high-pressure side pilot valve 22, there is no need for an operator to perform any switching operation. As a result, since an operation error does not happen and a movable part accompanying the switching is not present, either, trouble, such as a failure, hardly occurs, and the reliability of the safety valve system 20A increases.

Simply by opening and closing the first opening-closing valves 27 and the second opening-closing valves 28, it is possible to easily perform switching between the high-pressure side pilot valve 22 and the low-pressure side pilot valve 23.

Moreover, the first opening-closing valves 27 and the second opening-closing valves 28 are respectively provided on both sides of the low-pressure side pilot valve 23. Accordingly, if the first opening-closing valves 27 and the second opening-closing valves 28 on both sides of the low-pressure side pilot valve 23 are closed, a state where the pressure P is not reliably introduced into the low-pressure side pilot valve 23 is brought about. As a result, the reliability of the safety valve system can be improved.

The pressure gauge 30 that detects the pressure between the first opening-closing valves 27 and the second opening-closing valves 28 on both sides of the low-pressure side pilot valve 23 is provided. Accordingly, if the pressure P detected by the pressure gauge 30 increases in a state where the first opening-closing valves 27 and the second opening-closing valve 28 on both sides of the low-pressure side pilot valve 23 are closed, occurrence of leak in any of the first opening-closing valves 27 and the second opening-closing valves 28 can be detected.

A plurality of the first opening-closing valves 27 and a plurality of the second opening-closing valves 28 are provided in series, respectively. Accordingly, in a case where trouble has occurred in one of the plurality of first opening-closing valves 27 or the plurality of second opening-closing valves 28, it is possible to perform switching to the other first opening-closing valves 27 and the other second opening-closing valves 28. For that reason, switching of the high-pressure side pilot valve 22 and the low-pressure side pilot valve 23 can be reliably performed. As a result, the reliability of the safety valve system can be enhanced.

If the pressure P exceeds the operating pressure value X2 of the low-pressure side pilot valve 23 when transition is made from a state where only the pilot valve of which the operating pressure value X1 is highest is operated to a state where only the low-pressure side pilot valve 23 with the lower operating pressure value X2 is operated, the pressure P may be released simultaneously with the switching in the switching unit 24A. However, in such a case, by reducing pressure with the pressure-reducing valve 26 prior to performing the switching in the switching unit 24A, state, where the pressure P acting on the low-pressure side pilot valve 23 is lower than the operating pressure value X2 can be brought about. Accordingly, it is possible co suppress a situation where the pressure P is released simultaneously with the switching in the switching unit 24A.

For example, when the pressure-reducing valve 26 performs the pressure-reducing processing, it can be reliably confirmed whether or not the pressure P after the pressure reduction falls below the operating pressure values X1 and X2 of the low-pressure side pilot valve 23. For that reason, the system reliability can be further enhanced.

Figure 5:
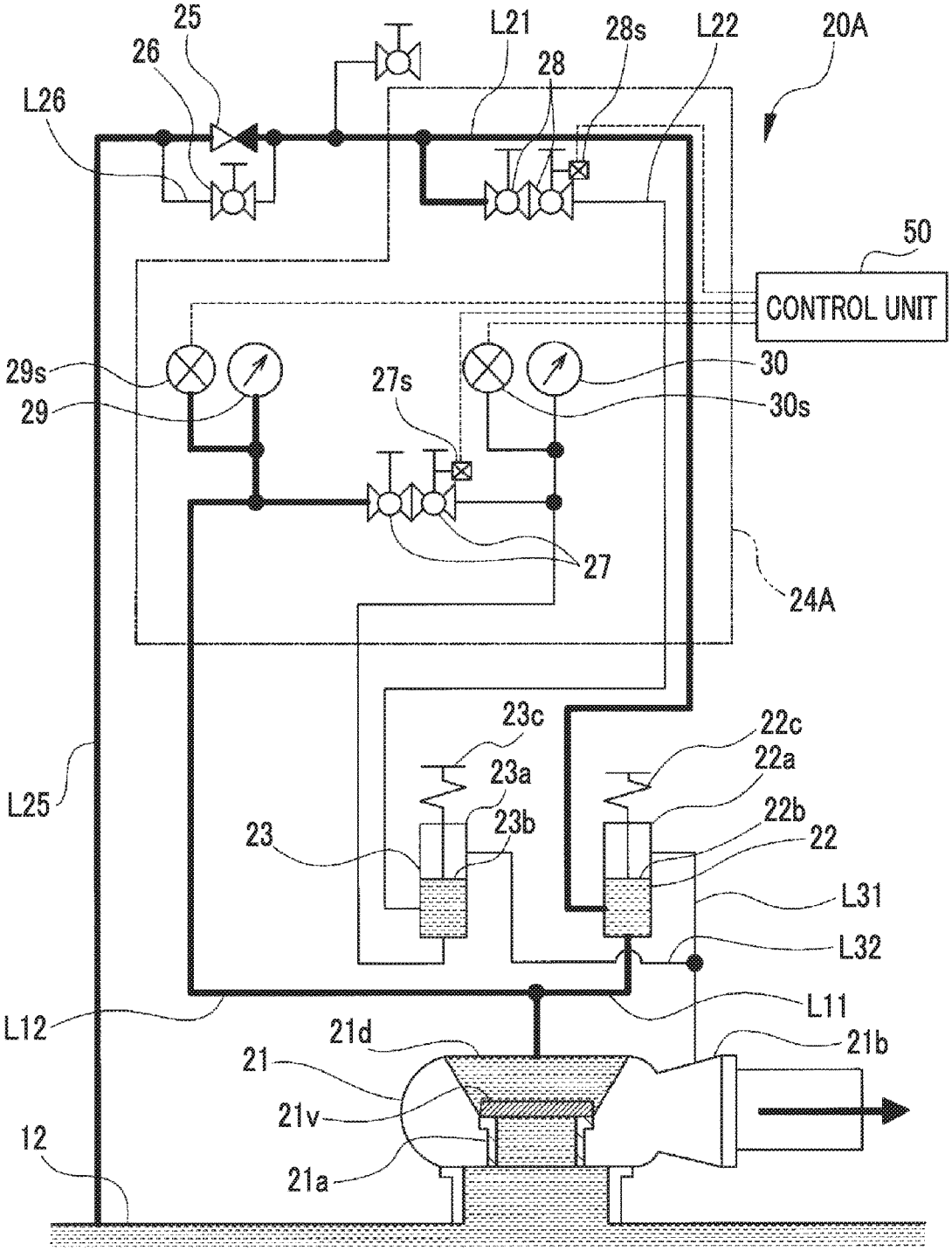
FIG. 5 is a view illustrating a state where a spring of a high-pressure side pilot valve is detached, in the above safety valve system.

FIG. 5 is a view illustrating a state where the spring 22*d* is detached from the high-pressure side pilot valve 22.

In the high-pressure side pilot valve 22, the plurality of springs 22*c* and 22*d* are attachable and detachable. Thus, for example, as illustrated in FIG. 5, the high-pressure side pilot valve 22 can be changed to the lower operating pressure value X1 by detaching at least one of the plurality of springs 22*c* and 22*d*. For that reason, in a case where trouble or the like has occurred in the low-pressure side pilot valve 23, the high-pressure side pilot valve 22 can be used instead.

In the high-pressure setting operation state of the carrier 10, the operating pressure value X1 at which the pressure P within the tank 12 is released can be set to a higher state as compared to the low-pressure setting operation state. For that reason, the pressure P within the tank 12 can be kept from being vainly released. Moreover, the stored matter within the tank 12 can be efficiently sent out to a ground facility.

Modification Example of First Embodiment

In the above first embodiment, the open/closed state of the first opening-closing valves 27 and the second opening-closing valves 28 may be confirmed by the control unit 50 of the safety valve system 20A confirms with the detection signals from the limit switches 27*s* and 28*s* that are respectively provided in the first opening-closing valves 27 and the second opening-closing valves 28. However, the confirmation of the open/closed state of the first opening-closing valves 27 and the second opening-closing valve 28 is not limited to this method. The limit switches 27*s* and 28*s* may be omitted, and an operator may be made to visually confirm the open/closed state of the first opening-closing valves 27 and the second opening-closing valves 28. Moreover, a case where the first opening-closing valves 27 and the second opening-closing valves 28 are electromagnetic valves including the limit switches 27*s* and 28*s*, respectively, have been described in the first embodiment. However, the first opening-closing valves 27 and the second opening-closing valves 28 may be respectively manual valves with an opening/closing detector. In this case, detecting units that detect the open/closed state of the manual valves with an opening/closing detector instead of the control unit 50. In this case, a user, who has confirmed the open/closed state with the detecting units disposed at the positions apart from the manual valves with an opening/closing detector, manually performs a valve opening operation and a valve closing operation.

In the above first embodiment, the detection value of the pressure gauge 30 is acquired from the pressure transmitter 30*s*, and the open/closed state of the first opening-closing valves 27 and the second opening-closing valves 28 is monitored by the control unit 50 of the safety valve system 20A. However, the confirmation of the open/closed state of the first opening-closing valves 27 and the second opening-closing valve 28 is not limited to this method. An operator may visually confirm the open/closed state of the first opening-closing valves 27 and the second opening-closing valves 28. If a configuration including the limit switches 27*s* and 28*s* while omitting the pressure transmitter 30*s* is provided, the open/closed state of the first opening-closing valve and the second opening-closing valve 28 may be confirmed by the control unit 50 of the safety valve system 20A with the detection signals from the limit switches 27*s* and 28*s*.

In the above first embodiment, the detection value of the pressure gauge 29 that detects the pressure P of the dome chamber 21*d* of the main valve 21 is acquired from the pressure transmitter 29*s*, and whether or not the pressure-reducing processing using the pressure-reducing valve 26 is correctly performed is confirmed by the control unit 50 of the safety valve system 20A. However, the confirmation as to whether or not the pressure-reducing processing using the pressure-reducing valve 26 is performed correctly is not limited to this method. The pressure transmitter 29*s* may be omitted.

Second Embodiment

Next, a safety valve system, a tank, a ship, and an operation method or a safety valve system on ships related to a second embodiment of this invention will be described. The second embodiment to be described below is different from the first embodiment only in the configuration of the switching unit. For that reason, the same portions as those of the first embodiment will be designated by the same reference signs, and duplicate description thereof will be omitted.

Figure 6:
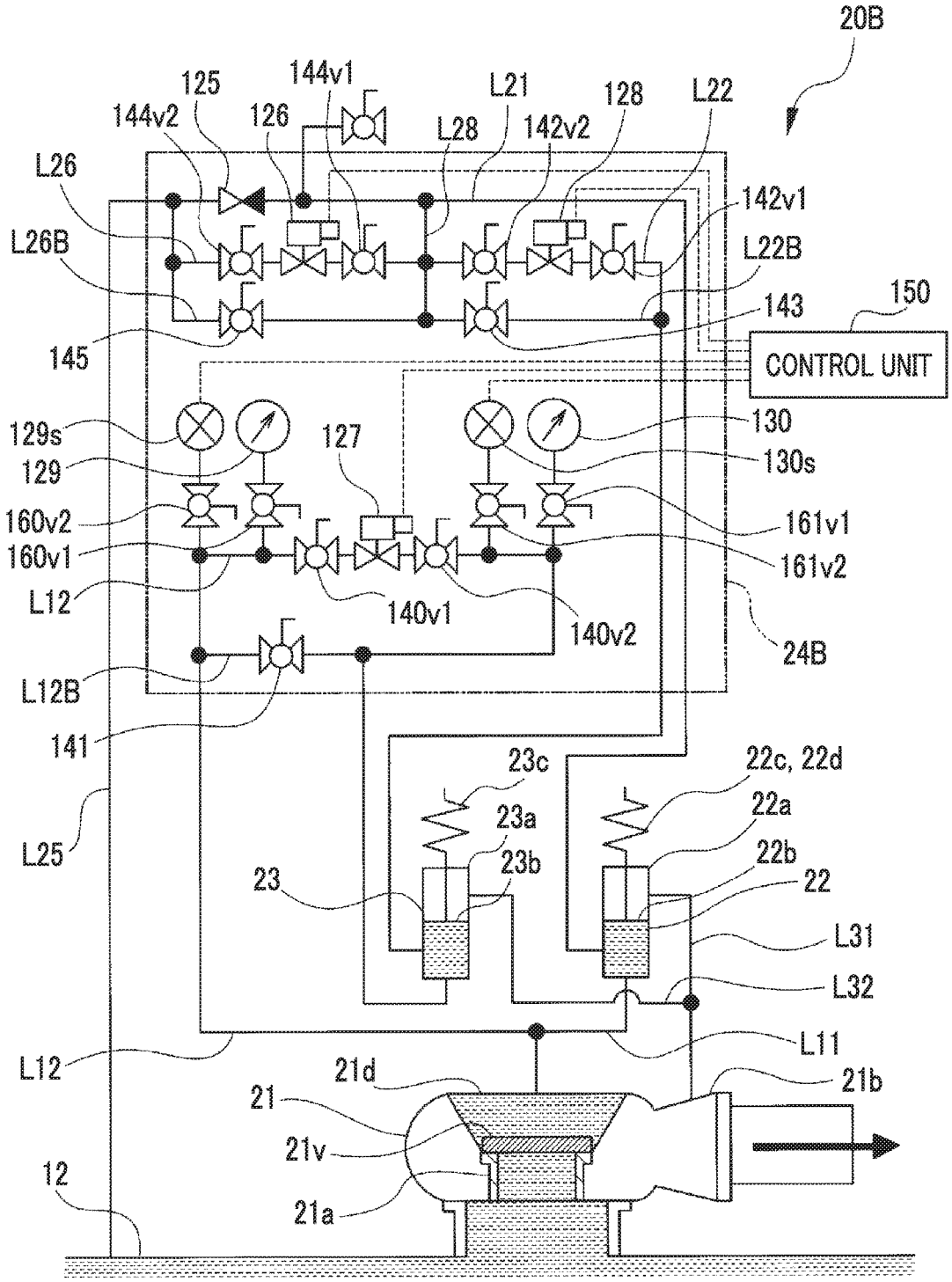
FIG. 6 is a view illustrating the configuration of a safety valve system related to a second embodiment of this invention.

FIG. 6 is a view illustrating the configuration of a safety valve system related to the second embodiment of this invention.

As illustrated in FIG. 6, a safety valve system 205 in this embodiment includes the main valve 21, the high-pressure side pilot valve 22, the low-pressure side pilot valve 23, a switching unit 24B, a check valve 125, and a pressure-reducing electromagnetic valve 126.

The high-pressure side pilot valve 22 is brought into a state where the pressure P of the gas acts on the first side of the valve body 22*b* as the gas within the tank 12 flows into the housing 22*a* via the return line L25 and the first return line L21. Since the biasing force caused by the springs 22*c* and 22*d* is acting on the second side of the valve body 22*b*, the valve body 22*b* maintains a closed state unless the pressure P exceeds the biasing force.

If the pressure P exceeds the biasing force of the springs 22*c* and 22*d*, the valve body 22*b* is opened. Accordingly, the gas introduced into the housing 22*a* from the first return line L21 flows into the release port 21*b* of the main valve 21 via the first pressure release line L31. Then, the pressure of the first pressure introduction line L11 connected to the housing 22*a* decreases, and the pressure of the dome chamber 21*d* of the main valve 21 decreases. As a result, a pressure difference occurs between the introduction port 21*a* of the main valve 21 and the dome chamber 21*d*, and the valve body 21*v* is opened to allow the introduction port 21*a* and the release port 21*b* to communicate with each other. Accordingly, the pressure P within the tank 12 is released through the main valve 21.

The low-pressure side pilot valve 23 is brought into a state where the pressure P of the gas within the tank 12 acts on the first side of the valve body 23*h* as the gas within the tank 12 flows into the housing 23*a* via the return line L25 and the second return line L22. Since the biasing force caused by the spring 23*c* is acting on the second side of the valve body 23*b*, the valve body 23*b* maintains the closed state unless the pressure P exceeds the biasing force.

If the pressure P exceeds the biasing force of the spring 23*c*, the valve body 23*h* is opened, and the gas introduced into the housing 23*a* from the second return line L22 flows into the release port 21*b* of the main valve 21 via the second pressure release line L32. Then, the pressure of the second pressure introduction line L12 decreases, and the pressure of the dome chamber 21*d* of the main valve 21 also decreases. As a result, a pressure difference occurs between the introduction port 21*a* of the main valve 21 and the dome chamber 21*d*, and the valve body 21*v* is opened to allow the introduction port 21*a* and the release port 21*b* to communicate with each other. Accordingly, the pressure P within the tank 12 is released through the main valve 21. Here, the number of springs 23*c* of the low-pressure side pilot valve 23 than the number of springs of the high-pressure side pilot valve 22, and the operating pressure value X2 is set to be low.

The switching unit 24B performs switching between introduction and non-introduction of the gas within the tank 12 into the low-pressure side pilot valve 23. The switching unit 24B includes a first electromagnetic valve (opening-closing valve) 127 and a second electromagnetic valve (opening-closing valve) 128.

The first electromagnetic valve 127 is provided at the second pressure introduction line L12 closer to the main valve 21 than the low-pressure side pilot valve 23. The opening/closing operation of the first electromagnetic valve 127 is controlled by a control unit 150 of the safety valve system 20B.

The first electromagnetic valve 127 includes manual cutoff valves 140*v*1 and 140*v*2 in front of and behind itself.

A bypass line (bypass flow passage) L12B is provided in parallel with the second pressure introduction line L12 in which the first electromagnetic valve 127 is provided. The bypass line L12B is formed so as to branch from the second pressure introduction line L12 and bypass the first electromagnetic valve 127. The bypass line L12B includes a manual bypass valve 141.

Here, normally, the manual cutoff valves 140*v*1 and 140*v*2 are always open. Normally, the bypass valve 141 is always closed. When the first electromagnetic valve 127 is maintained or replaced, the manual cutoff valves 140*v*1 and 140*v*2 are closed, and the bypass valve 141 is opened.

The second electromagnetic valve 128 is provided at the second return line L22 opposite to the main valve 21 across the low-pressure side pilot valve 23. The opening/closing operation of the second electromagnetic valve 128 is controlled by the control unit 150 of the safety valve system 20B.

The second electromagnetic valve 128 includes manual cutoff valves 142*v*1 and 142*v*2 in front of and behind itself.

A bypass line (bypass flow passage) L22B is provided in parallel with the second return line L22 in which the second electromagnetic valve 128 is provided. The bypass line L22B is formed so as to branch from the second return line L22 and bypass the second electromagnetic valve 128. The bypass line L22B includes a manual bypass valve 143.

Here, normally, the manual cutoff valves 142*v*1 and 142*v*2 are always open. Normally, the bypass valve 143 is always closed. When the second electromagnetic valve 128 is maintained or replaced, the manual cutoff valves 142*v*1 and 142*v*2 are closed, and the bypass valve 143 is opened.

The first return line L21, the second return line L22, and bypass line L22B in this second embodiment are coupled together by a coupling line L28, respectively. Specifically, the coupling line L28 is connected to the first return line L21 at a position closer to the low-pressure side pilot valve 23 than the check valve 125 to be described below. Additionally, the coupling line L28 is connected to the second return line L22 at a position between the cutoff valve 142*v*2 adjacent to the second electromagnetic valve 128 and the cutoff valve 144*v*1 adjacent to the pressure-reducing electromagnetic valve 126 to be described below. Additionally, the coupling line L28 is coupled to the bypass line L22B at a position between the bypass valve 143 and a bypass valve 145 (to be described below) that are connected in series.

By opening and closing the first electromagnetic valve 127 and the second electromagnetic valve 128, the switching unit 24A is capable of performing switching between introduction and non-introduction of the gas within the tank 12 into the low-pressure side pilot valve 23. More specifically, by opening the first electromagnetic valve 127 and the second electromagnetic valve 128, the gas within the tank 12 is introduced into the low-pressure side pilot valve 23. If both of the first electromagnetic valve 127 and the second electromagnetic valve 128 are closed, the introduction of the gas within the tank 12 into the low-pressure side pilot valve 23 is cut off.

The switching unit 24B further includes a pressure gauge (system internal pressure detecting unit) 129, a pressure transmitter 129*s*, a pressure gauge (pressure detecting unit) 130, and a pressure transmitter 130*s*.

The pressure gauge 129 measures and displays the pressure P of the dome chamber 21*d* of the main valve 21. The pressure gauge 129 is branched and connected to the second pressure introduction line L12 at a position between the first electromagnetic valve 127 and the main valve 21, more specifically, to the second pressure introduction line L12 at a position closer to the main valve 21 than the manual cutoff valve 140*v*1. The pressure gauge 129 is provided via a manual cutoff valve 160*v*1 so as to be cut off from the second pressure introduction line L12 during maintenance or the like.

The pressure transmitter 129*s* detects the pressure P of the dome chamber 21*d* of the main valve 21 to output the detection signal to the control unit 150 of the safety valve system 20B. The pressure transmitter 129*s* is provided in parallel with the pressure gauge 129 so as to be adjacent thereto. The pressure transmitter 129*s* is provided via the cutoff valve 160*v*2 at a position closer to the main valve 21 than the first electromagnetic valve 127 of the second pressure introduction line L12, more specifically, at a position closer to the main valve 21 than the cutoff valve 140*v*1. In FIG. 6, the pressure transmitter 129*s* is disposed at a position closer to the main valve 21 than the pressure gauge 129. However, the arrangement of the pressure gauge 129 and the pressure transmitter 129*s* is not limited to this arrangement. For example, the pressure transmitter 129*s* illustrated in FIG. 6 may be disposed on a side closer in the first electromagnetic valve 127 than the pressure gauge 129.

The pressure gauge 130 measures and displays the pressure P of the gas introduced into the low-pressure side pilot valve 23. The pressure gauge 130 is branched and connected to the second pressure introduction line L12 at a position between the first electromagnetic valve 127 and the low-pressure side pilot valve 32, more specifically, to the second pressure introduction line L12 at a position closer to the low-pressure side pilot valve 23 than the manual cutoff valve 140*v*2. Similarly to the above-described pressure gauge 129, the pressure gauge 130 is provided via a manual cutoff valve 161*v*1 so as to be cut off from the second pressure introduction line L12 during maintenance or the like.

The pressure transmitter 130*s* detects the pressure P of the gas introduced into the low-pressure side pilot valve 23 to output the detection signal to the control unit 150 of the safety valve system 20B. The pressure transmitter 130*s* is provided in parallel with the pressure gauge 130 so as to be adjacent thereto. The pressure transmitter 130*s* is provided via the cutoff valve 161*v*2 at a position closer to the low-pressure side pilot valve 23 than the first electromagnetic valve 127 of the second pressure introduction line L12, more specifically, at a position closer to the low-pressure side pilot valve 23 than the cutoff valve 140*v*2. In FIG. 6, the pressure transmitter 130*s* is disposed at a position closer to the first electromagnetic valve 127 than the pressure gauge 130. However, the arrangement of the pressure gauge 130 and the pressure transmitter 130*s* is not limited to this arrangement. For example, the pressure transmitter 130*s* illustrated in FIG. 6 may be disposed on a side closer to the low-pressure side pilot valve 23 than the pressure gauge 130.

Here, in FIG. 6, a case where the pressure gauge 129 and the pressure transmitter 129*s* are individually branched and connected to the second pressure introduction line L12 has been described. Moreover, a case where the pressure gauge 130 and the pressure transmitter 130*s* are individually branched and connected to the second pressure introduction line L12 has been described. However, the present invention is not limited to these configurations, and dendritical branch and connection to the second pressure introduction line L12 may be made, as in the pressure gauge 30 and the pressure transmitter 30*s* of the first embodiment.

The check valve 125 is provided at the return line 125, and cuts off the flow of gas toward the tank 12 from the high-pressure side pilot valve 22, similarly to the check valve of the first embodiment. On the contrary, the check valve 125 allows the inflow of the gas toward the high-pressure side pilot valve 22 and the low-pressure side pilot valve 23 from the tank 12.

The pressure-reducing electromagnetic valve 126 is provided at a bypass line L26 that bypasses the check valve 125. By opening the pressure-reducing electromagnetic valve 126, the gas in each line within the safety valve system 20B can be returned to the tank 12, and the pressure of each line can be reduced. The opening/closing operation of the pressure-reducing electromagnetic valve 126 is controlled by the control unit 150 of the safety valve system 20B.

The pressure-reducing electromagnetic valve 126 includes manual cutoff valves 144v1 and 144v2 in front of and behind itself.

A second bypass line L26B is provided in parallel with the bypass line L26 in which the pressure-reducing electromagnetic valve 126 is provided. The second bypass line L26B is formed so as to branch from the bypass line L26 and bypass the pressure-reducing electromagnetic valve 126. The second bypass line L126B includes the manual bypass valve 145.

The bypass line L26 and the second bypass line L26B are connected to the coupling line L28.

Here, normally, the manual cutoff valves 144v1 and 144v2 are always open. Normally, the bypass valve 145 is always closed. When the pressure-reducing electromagnetic valve 126 is maintained or replaced, the manual cutoff valves 144v1 and 144v2 are closed, and the bypass valve 145 is opened and closed instead of the pressure-reducing electromagnetic valve 126.

In the above-described carrier 10, as in the above first embodiment, the operating pressure value of the safety valve system 20B is changed during navigation and anchorage.

That is, when the carrier 10 is at anchor, both of the first electromagnetic valve 127 and the second electromagnetic valve 128 of the switching unit 24B of the low-pressure side pilot valve 23 are closed, and the introduction of the gas within the tank 12 into the low-pressure side pilot valve 23 is cut off. Then, the pressure P within the tank 12 acts only on the high-pressure side pilot valve 22. The high-pressure side pilot valve 22 maintains closed state unless the pressure P exceeds the operating pressure value X1, and the high-pressure side pilot valve 22 is opened if the pressure P exceeds the operating pressure value X1. Accordingly, the pressure P within the tank 12 is released through the main valve 21, and the pressure P within the tank 12 can be kept from becoming excessively high.

When the carrier 10 is navigating, both of the first electromagnetic valve 127 and the second electromagnetic valve 128 of the switching unit 24B of the low-pressure side pilot valve 23 are opened. Then, the pressure P within the tank 12 acts on the high-pressure side pilot valve 22 and the low-pressure side pilot valve 23. The low-pressure side pilot valve 23 maintains the closed state unless the pressure P exceeds the operating pressure value X2 of the low-pressure side pilot valve 23, and the low-pressure side pilot valve 23 is opened if the pressure P exceeds the operating pressure value X2. Accordingly, the pressure P within the tank 12 is released through the main valve 21, and the pressure P within the tank 12 can be kept from becoming excessively high.

Hence, according to the above-described second embodiment, as in the above first embodiment, if switching is performed in the switching unit 24B that only the low-pressure side pilot valve 23 is operated, only a high-pressure side pilot valve 22 of which the operating pressure value X1 is highest can be brought into an operable state. If the switching unit 24B switches the low-pressure side pilot valve 23 to the operable state, the low-pressure side pilot valve 23 can brought into the operable state. Accordingly, simply by performing a switching operation with the switching unit 24B without performing attachment and detachment of a spring, or the like, it is possible to easily switch the operating pressure values X1 and X2 in the safety valve system 20B.

Moreover, the high-pressure side pilot valve 22 of which the operating pressure value X1 is highest always operates irrespective of the operation state of the low-pressure side pilot valve 23. For that reason, since there is no need for an operator to perform any switching operation at least in the high-pressure side pilot valve 22, an operation error does not happen. Since a movable part accompanying the switching is not present, either, trouble, such as a failure, hardly occurs, and the reliability of the safety valve system 20B increases.

Moreover, since the first electromagnetic valve 127, the second electromagnetic valve 128, and the pressure-reducing electromagnetic valve 126 are electromagnetic valves, the opening and closing of the first electromagnetic valve 127, the second electromagnetic valve 128, and the pressure-reducing electromagnetic valve 126 can be performed by a remote operation, and the open/closed state of the first electromagnetic valve 127, the second electromagnetic valve 128, and the pressure-reducing electromagnetic valve 126 can also be monitored. Accordingly, it is possible to easily perform switching between the high-pressure side pilot valve 22 and the low-pressure side pilot valve 23 and the opening and closing of the pressure-reducing electromagnetic valve 126.

Moreover, the cutoff valves 140v1, 140v2, 142v1, 142v2, 144v1, and 144v2 that cuts off flows to the first electromagnetic valve 127, the second electromagnetic valve 128, and the pressure-reducing electromagnetic valve 126 are openably and closably provided in front of and behind the first electromagnetic valve 127, the second electromagnetic valve 128, and the pressure-reducing electromagnetic valve 126. Accordingly, when the first electromagnetic valve 127, the second electromagnetic valve 128, and the pressure-reducing electromagnetic valve 126 are maintained or replaced, flows to the first electromagnetic valve 127, the second electromagnetic valve 128, and the pressure-reducing electromagnetic valve 126 can be cut off by closing the cutoff valves 140v1, 140v2, 142v1, 142v2, 144v1, and 144v2 in front of and behind these electromagnetic valves. This improves workability when maintenance or the like of the first electromagnetic valve 127, the second electromagnetic valve 128, and the pressure-reducing electromagnetic valve 126 is performed.

Moreover, the bypass line L12B and L22B and the second bypass line L26B that are in parallel with the first electromagnetic valve 127, the second electromagnetic valve 128, and the pressure-reducing electromagnetic valve 126, and the bypass valves 141, 143, and 145 that open and close the bypass lines L12B and L22B and the second bypass line L26B are provided. Accordingly, when the first electromagnetic valve 127, the second electromagnetic valve 128, and the pressure-reducing electromagnetic valve 126 are maintained or replaced, flows to the first electromagnetic valve 127, the bypass lines L12B and L22B and the second bypass line L26B can be made to bypass the gas that flows through the first electromagnetic valve 127, the second electromagnetic valve 128, and the pressure-reducing electromagnetic valve 126 by opening the bypass valve 141, 143, and 145 while closing the cutoff valves 140v1, 140v2, 142v1, 142v2, 144v1, and 144v2 disposed in front of and behind these electromagnetic valves. Hence, it is possible to employ the safety valve system 20B while performing an operation.

Moreover, the first electromagnetic valve 127 and the second electromagnetic valve 128 are respectively provided on both sides of the low-pressure side pilot valve 23. For that reason, if the first electromagnetic valve 127 and the second electromagnetic valve 128 on both sides of the low-pressure side pilot valve 23 are closed, a state where the pressure P is not reliably introduced into the low-pressure side pilot valve 23 is brought about. As a result, the reliability of the safety valve system can be improved.

Moreover, the pressure gauge 130 that detects the pressure between the first electromagnetic valve 127 and the second electromagnetic valve 128 *n* both sides of the low-pressure side pilot valve 23 is provided. Accordingly, if the pressure P detected by the pressure gauge 130 increases in a state where the first electromagnetic valve 127 and the second electromagnetic valve 128 and the second opening-closing valve 128 on both sides of the low-pressure side valve 23 are closed, occurrence of leak in any of the first electromagnetic valve 127 and the second electromagnetic valve 128 can be detected.

Other Modification Examples

This invention is not limited to the above-described embodiments, and various changes can be added to the above-described embodiments without departing the concept of the invention. That is, the specific shapes, configurations, and the like that are mentioned in the above embodiments are merely an example, and can be appropriately changed.

For example, in the above embodiments, the tank 12 is loaded with liquefied gas, such as LNG or LPG. However, even in a case where other types of gases or liquids are accommodated, this invention is applicable.

The above safety valve systems 20A and 20B are applicable not only to the tank 12 but to piping or the like. Moreover, this invention is applicable to tanks or piping that are not mounted on ships.

INDUSTRIAL APPLICABILITY

This invention can be applied to a safety valve system, a tank, and an operation method for safety valve system on ships, and can easily switch the operating pressure value of a safety valve.

REFERENCE SIGNS LIST

10: CARRIER (SHIP)
11: HULL
12: TANK (PRESSURE SOURCE, TANK BODY)
15: TANK ACCOMMODATING PART
20A, 20B: SAFETY VALVE SYSTEM
21: MAIN VALVE
21*a*: INTRODUCTION PORT
21*b*: RELEASE PORT
21*d*: DOME CHAMBER
21*v*: VALVE BODY
22: HIGH-PRESSURE SIDE PILOT VALVE
22*a*: HOUSING
22*b*: VALVE BODY
22*c*, 22*d*: SPRING
23: LOW-PRESSURE SIDE PILOT VALVE
23*a*: HOUSING
23*b*: VALVE BODY
23*c*: SPRING
24A, 24B: SWITCHING UNIT
25: CHECK VALVE
26: PRESSURE-REDUCING VALVE (PRESSURE-REDUCING UNIT)
27: FIRST OPENING-CLOSING VALVE (OPENING-CLOSING VALVE)
27*s*: LIMIT SWITCH
28: SECOND OPENING-CLOSING VALVE (OPENING-CLOSING VALVE)
28*s*: LIMIT SWITCH
29, 129: PRESSURE GAUGE (SYSTEM INTERNAL PRESSURE DETECTING UNIT)
29*s*, 129*s*: PRESSURE TRANSMITTER
30, 130: PRESSURE GAUGE (PRESSURE DETECTING UNIT)
30*s*, 130*s*: PRESSURE TRANSMITTER
125: CHECK VALVE
126: PRESSURE-REDUCING ELECTROMAGNETIC VALVE
127: FIRST ELECTROMAGNETIC VALVE (OPENING-CLOSING VALVE)
128: SECOND ELECTROMAGNETIC VALVE (OPENING-CLOSING VALVE)
129: PRESSURE GAUGE
129*s*: PRESSURE TRANSMITTER
130: PRESSURE GAUGE
130*s*: PRESSURE TRANSMITTER
140*v*1, 140*v*2, 142*v*1, 142*v*2: CUTOFF VALVE
141, 143: BYPASS VALVE
144*v*, 144*v*2: CUTOFF VALVE
145: BYPASS VALVE
50, 150: CONTROL UNIT
160*v*1, 160*v*2, 161*v*1, 161*v*2: CUTOFF VALVE
L11: FIRST PRESSURE INTRODUCTION LINE
L12: SECOND PRESSURE INTRODUCTION LINE (PRESSURE INTRODUCTION LINE)
L12B, L22B: BYPASS LINE (BYPASS FLOW PASSAGE)
L21: FIRST RETURN LINE
L22: SECOND RETURN LINE
L25: RETURN LINE
L26: BYPASS LINE
L26B: SECOND BYPASS LINE
L31: FIRST PRESSURE RELEASE LINE
L32: SECOND PRESSURE RELEASE LINE
P: PRESSURE
X1: OPERATING PRESSURE VALUE
X2: OPERATING PRESSURE VALUE

The invention claimed is:

1. A safety valve system comprising:

a main valve that has an introduction port into which pressure from a pressure source is to be introduced, a release port which is configured to release the pressure, a valve body that is arranged between the introduction port and the release port, and a dome chamber, the valve body being in a closed state when a pressure of the introduction port and a pressure of the dome chamber are equal to each other, and the valve body being in an open state when the pressure of the dome chamber decreases and a pressure difference occurs between the introduction port and the dome chamber;

a high-pressure side pilot valve that is set to a first operating pressure value and that is configured to release the pressure by allowing the introduction port and the release port to communicate with each other by opening the valve body when the pressure exceeds the first operating pressure value;

a low-pressure side pilot valve that is set to a second operating pressure value lower than the first operating pressure value and that is configured to release the pressure by allowing the introduction port and the release port to communicate with each other by opening the valve body when the pressure exceeds the second operating pressure value;

a switching unit that is configured to perform switching between operation and non-operation of the low-pressure side pilot valve;

a first pressure introduction line connecting the high-pressure side pilot valve and the dome chamber;

a first return line connecting the pressure source and the high-pressure side pilot valve;

a second pressure introduction line connecting the low-pressure side pilot valve and the dome chamber; and a second return line connecting the pressure source and the low-pressure side pilot valve;

wherein the switching unit includes a first opening-closing valve provided on the second pressure introduction line and a second opening-closing valve provided on the second return line.

2. The safety valve system according to claim 1, further comprising:

a pressure detector that is configured to detect a pressure between the first opening-closing valve and the second opening-closing valve.

3. The safety valve system according claim 1, wherein each of the first opening-closing valve and the second opening-closing valve is an electromagnetic valve and wherein the safety valve system further comprises a controller that is configured to control an opening/closing operation of the electromagnetic valve.

4. The safety valve system according to claim 1, further comprising:

cutoff valves that are provided in front of and behind each of the first opening-closing valve and the second opening-closing valve and are capable of cutting off flow each of to the first opening-closing valve and the second opening-closing valve.

5. The safety valve system according to claim 4, further comprising:

a bypass flow passage that is parallel with each of the first opening-closing valve and the second opening-closing valve; and a bypass valve that is configured to open and close the bypass flow passage.

6. The safety valve system according to claim 1, further comprising:

a pressure-reducer that is configured to reduce the pressure to be introduced into the high-pressure side pilot valve and the low-pressure side pilot valve.

7. The safety valve system according to claim 1, further comprising:

a system internal pressure detector that is configured to detect the pressure to be introduced from the pressure source.

8. The safety valve system according to claim 1, wherein the high-pressure side pilot valve is set to the first operating pressure value by including a plurality of springs in series, and the plurality of springs are attachable and detachable.

9. A tank comprising:

a tank body that accommodates a fluid as the pressure source; and the safety valve system according to claim 1.

10. A ship comprising:

a hull; and the tank according to claim 9 mounted on the hull.

11. An operation method for the safety valve system in the ship according to claim 10, wherein the first opening-closing valve and the second opening-closing valve are closed in a state where the hull is anchoring, and the first opening-closing valve and the second opening-closing valve are opened in a state where the hull is navigating.

12. The safety valve system according to claim 1, wherein each of the first opening-closing valve and the second opening-closing valve is a manual valve with an opening/closing detector, and wherein the safety valve system further comprises a detector that is configured to detect opening and closing of the manual valve with the opening/closing detector.

* * * * *